US009451834B2

(12) United States Patent
Pacella

(10) Patent No.: US 9,451,834 B2
(45) Date of Patent: Sep. 27, 2016

(54) PORTABLE BABY SUPPORTING DEVICE

(71) Applicant: Jonathan M. Pacella, Coatesville, PA (US)

(72) Inventor: Jonathan M. Pacella, Coatesville, PA (US)

(73) Assignee: Wonderland Nurserygoods Company Limited, NT (HK)

( * ) Notice: Subject to any disclaimer, the term of this patent is extended or adjusted under 35 U.S.C. 154(b) by 0 days.

(21) Appl. No.: 14/552,493

(22) Filed: Nov. 25, 2014

(65) Prior Publication Data

US 2015/0157138 A1 Jun. 11, 2015

Related U.S. Application Data

(60) Provisional application No. 61/963,561, filed on Dec. 6, 2013.

(51) Int. Cl.

| | |
|---|---|
| ***A47D 5/00*** | (2006.01) |
| ***A47D 7/02*** | (2006.01) |
| ***A47D 11/00*** | (2006.01) |
| *A45C 9/00* | (2006.01) |

(52) U.S. Cl.

CPC ..... *A47D 5/006* (2013.01); *A47D 7/02* (2013.01); *A47D 11/005* (2013.01); *A45C 2009/002* (2013.01)

(58) Field of Classification Search

CPC ..... A47D 5/006; A47D 5/00; A47D 15/003; A47D 15/00; A47D 7/02; A47D 11/005; A47D 13/065; A47D 13/066; A45C 9/00; A45C 2009/002; A45C 2009/005; A45C 2009/007

See application file for complete search history.

(56) References Cited

U.S. PATENT DOCUMENTS

| | | | | |
|---|---|---|---|---|
| 2,277,406 | A * | 3/1942 | Mahr | 5/98.1 |
| 2,532,837 | A * | 12/1950 | De Puy | 160/377 |
| 2,740,680 | A * | 4/1956 | Hamilton | 108/80 |
| 3,296,633 | A * | 1/1967 | Rieger | 5/99.1 |
| 4,932,086 | A * | 6/1990 | Bergkvist | 4/546 |
| 5,918,329 | A * | 7/1999 | Huang | A47D 5/00 5/503.1 |
| 6,173,462 | B1 * | 1/2001 | Huang | A47D 5/00 5/507.1 |
| 6,539,563 | B1 * | 4/2003 | Hsia | A47D 7/04 248/150 |
| 6,598,837 | B1 * | 7/2003 | Howard et al. | 248/103 |
| 2003/0154547 | A1 * | 8/2003 | Hsia | A47D 7/002 5/99.1 |
| 2008/0209631 | A1 * | 9/2008 | Thomas et al. | 5/99.1 |

FOREIGN PATENT DOCUMENTS

| | | | |
|---|---|---|---|
| CN | 2297930 | Y | 11/1998 |
| CN | 101756472 | A | 6/2010 |

(Continued)

*Primary Examiner* — David E Sosnowski
*Assistant Examiner* — Amanda L Miller
(74) *Attorney, Agent, or Firm* — Winston Hsu; Scott Margo

(57) ABSTRACT

The invention provides a portable baby supporting device designed to be used anywhere for taking care of a baby and can be easily moved and stored to anywhere. The portable baby supporting device includes a base and a platform rotatably coupled to the base. The platform can either be stowed to be in parallel with the base or opened to be perpendicular to the base. When opened to a use status, the platform provides a first supporting surface for diaper changing, food feeding, or entertaining, etc. Necessary supplies can be stored in the compartments of the base in hand. The portable baby supporting device may also be collapsed to a minimized size for storage purpose, or oriented upside down, so that a higher changing table provided by the platform is accessible.

15 Claims, 11 Drawing Sheets

(56) References Cited

FOREIGN PATENT DOCUMENTS

| | | | | | |
|---|---|---|---|---|---|
| CN | 202980662 | U | | 6/2013 | |
| CN | 203220050 | U | | 10/2013 | |
| CN | 203505852 | U | | 4/2014 | |
| FR | 2305152 | A1 | * | 10/1976 | ..... A45F 4/00 |
| FR | 2642288 | A1 | * | 8/1990 | ..... A47D 7/002 |
| WO | 2014135094 | A1 | | 9/2014 | |

* cited by examiner

PORTABLE BABY SUPPORTING DEVICE

CROSS REFERENCE TO RELATED APPLICATIONS

This application claims the benefits of U.S. Provisional Applications No. 61/963,561, which was filed on Dec. 6, 2013 and is incorporated herein by reference.

BACKGROUND OF THE INVENTION

1. Field of the Invention

The invention relates to a caregiver apparatus, and more particularly, to a portable baby supporting device for diaper changing and baby napping.

2. Description of the Prior Art

In order to change the diaper of his/her child, feed the child, or soothe the child, a caregiver must have all the essentials close by, such as diapers, wipers diaper rash cream, powder, possibly a change of clothes for the baby, food and container, or entertainment stuff depending on the severity of the situation. It takes time to gather these essentials or to get all these stuff at hand. Oftentimes, a caregiver should be able to quickly respond whenever the child shows his/her needs; for example, the used diaper must be changed quickly, food should be well prepared, or comfort comes in no time, so that further mess or worsen condition may be avoided. Currently, in order to have a convenient station in the common area for taking care of the child, many caregivers have a basket(s) or a bag around, like under or beside the couch in the living room, with all the items in it. This basket/bag, however, is often accessible to the child, siblings or pets, so care must be given as to the contents of the basket/bag to avoid a safety hazard and/or a mess on the scene. Depending on the size of the basket/bag, it may also cause additional clutter to the area, which can fill up quickly with other baby gear, such as a swing, toys, bouncer seat, etc.

SUMMARY OF THE INVENTION

The invention provides an easy and convenient way to solve the problem mentioned above by providing a portable baby supporting device, which includes a base and a platform configurable at a first position or a second position with respect to the base.

According to an embodiment of the invention, The base includes a first side and a second side opposite to each other. The base also includes a mounting part located between the first side and the second side. The platform is rotatably coupled to the mounting part of the base and is configurable at a first position or a second position with respect to the base. When the platform is configured at the first position, the platform is folded parallel with the base and is fastened to the second side of the base. When the platform is configured at the second position, the base is placed on a flat surface with the first side and the platform is opened perpendicular to the base and provides a first supporting surface for placing a baby.

According to the embodiment of the invention, the base includes a front main frame and a rear main frame parallel with each other. The front main frame is configurable at a setup position or a collapsed position with respect to the rear main frame. When configured at the setup position, the front main frame is connected to, but apart from the rear main frame for a gap to form a room therebetween. When configured at the collapsed position, the front main frame is disconnected from the rear main frame.

According to the embodiment of the invention, the mounting part is located at the front main frame and the platform is rotatably coupled to the mounting part of the front main frame.

According to the embodiment of the invention, the base further includes a pair of frame support wires rotatably mounted on the front main frame. The pair of frame support wires may be rotated out of the front main frame to engage with the rear main frame and to support the front main frame apart from the rear main frame to form the room therebetween at the setup position. The pair of frame support wires maybe rotated to fold toward the front main frame, so that the front main frame adjoins the rear main frame at the collapsed position.

According to the embodiment of the invention, the rear main frame includes a plurality of clips on a rigid panel affixed to the rear main frame and the pair of frame support wires engage with the plurality of clips at the setup position.

According to the embodiment of the invention, the base further includes a soft goods wrapped around the front main frame and the rear main frame to enclose the room formed therebetween when the front main frame is configured at the setup position.

According to the embodiment of the invention, the soft goods includes a plurality of storage compartments.

According to the embodiment of the invention, the portable baby supporting device further includes a stop member. One end of the stop member is pivoted about the first side of the base and the other end of the stop member is slidably connected to the platform. The stop member is a pair of support wires.

According to the embodiment of the invention, the platform further includes a track disposed near the mounting part of the base. The other end of the stop member is disposed in the track and is slidable between a front end and a rear end of the track.

According to the embodiment of the invention, the front end of the track is crooked and the other end of the stop member is locked in the crooked front end when the platform is configured at the second position. When the platform is configured at the first position, the other end of the stop member is located at the rear end of the track.

According to the embodiment of the invention, the base further includes an outrigger rotatably mounted at the second side and configurable at a stowed position or a use position 90 degree rotation from the stowed position.

According to the embodiment of the invention, when the outrigger is rotated to the use position and the platform is configured at the second position, the base is placed on the flat surface with the outrigger and the platform provides a second supporting surface for placing the baby.

According to the embodiment of the invention, the platform further includes a soft goods for providing the first supporting surface and the second supporting surface at both sides.

According to the embodiment of the invention, the portable baby supporting device further includes securing means coupled to the base and the platform for securing the platform at the second position when the base is placed on the flat surface with the outrigger.

According to the embodiment of the invention, the platform is a U-shape frame with both ends rotatably coupled to the mounting part and the platform further includes a soft goods wrapped around the U-shape frame for providing the first supporting surface.

According to the embodiment of the invention, when the platform is configured at the first position, the platform is fastened to the second side of the base by fastening means.

According to the embodiment of the invention, the portable baby supporting device further includes an auxiliary arm rotatably coupled to the base for soothing or entertaining the baby, and further includes a handle or a shoulder carrying strap affixed to the second side of the base.

According to the embodiment of the invention, the base is configurable at a setup position or a collapsed position; when configured at the setup position, the base is a box-like structure, and when configured at the collapsed position, the base is a planar structure.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. In the following discussion and in the claims, the terms "include" and "comprise" are used in an open-ended fashion. Also, the term "couple" is intended to mean either an indirect or direct electrical connection. Thus, if a first device is coupled to a second device, that connection may be through a direct electrical connection, or through an indirect electrical connection via other devices and connections.

Figure 1:
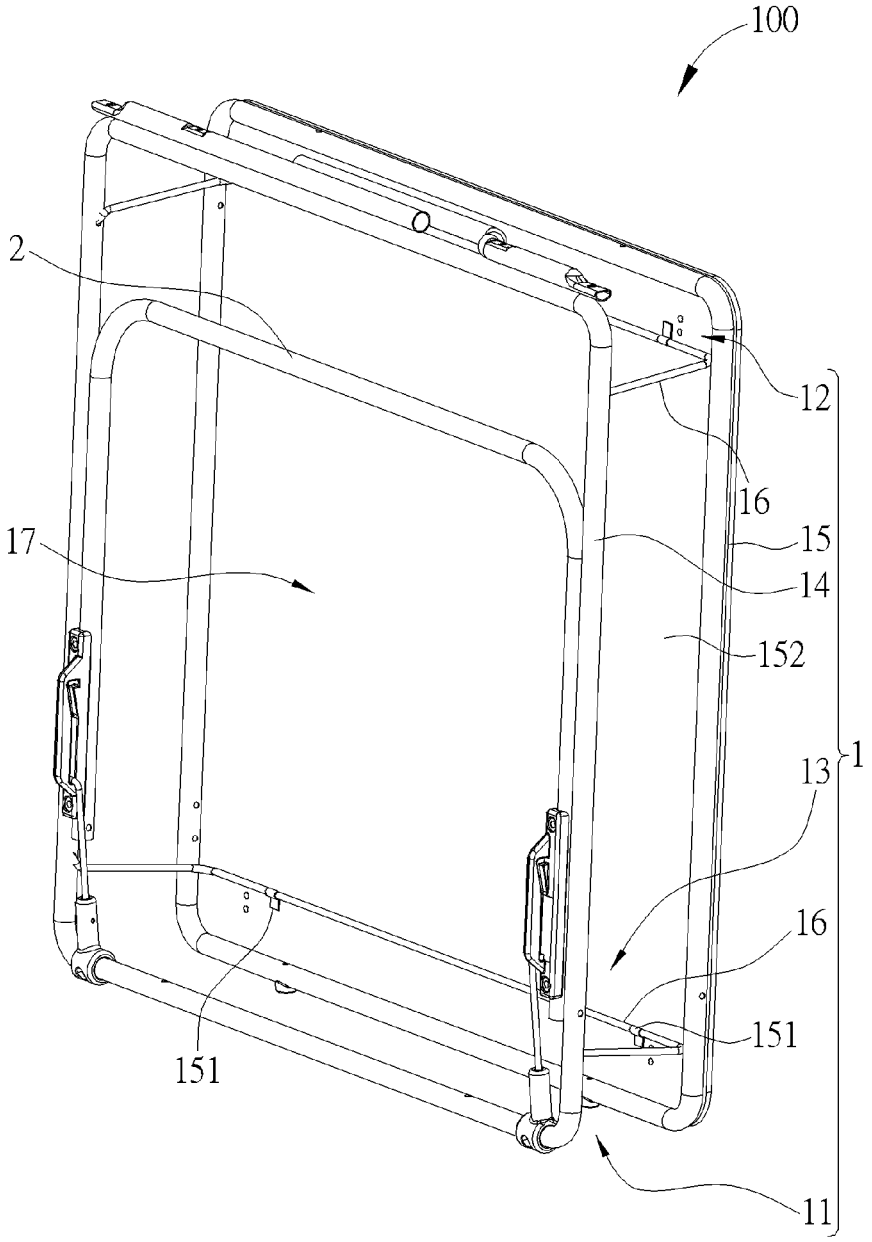
FIG. 1 is a schematic diagram of a portable baby supporting device where a platform is in a stowed status according to an embodiment of the invention.
Figure 2:
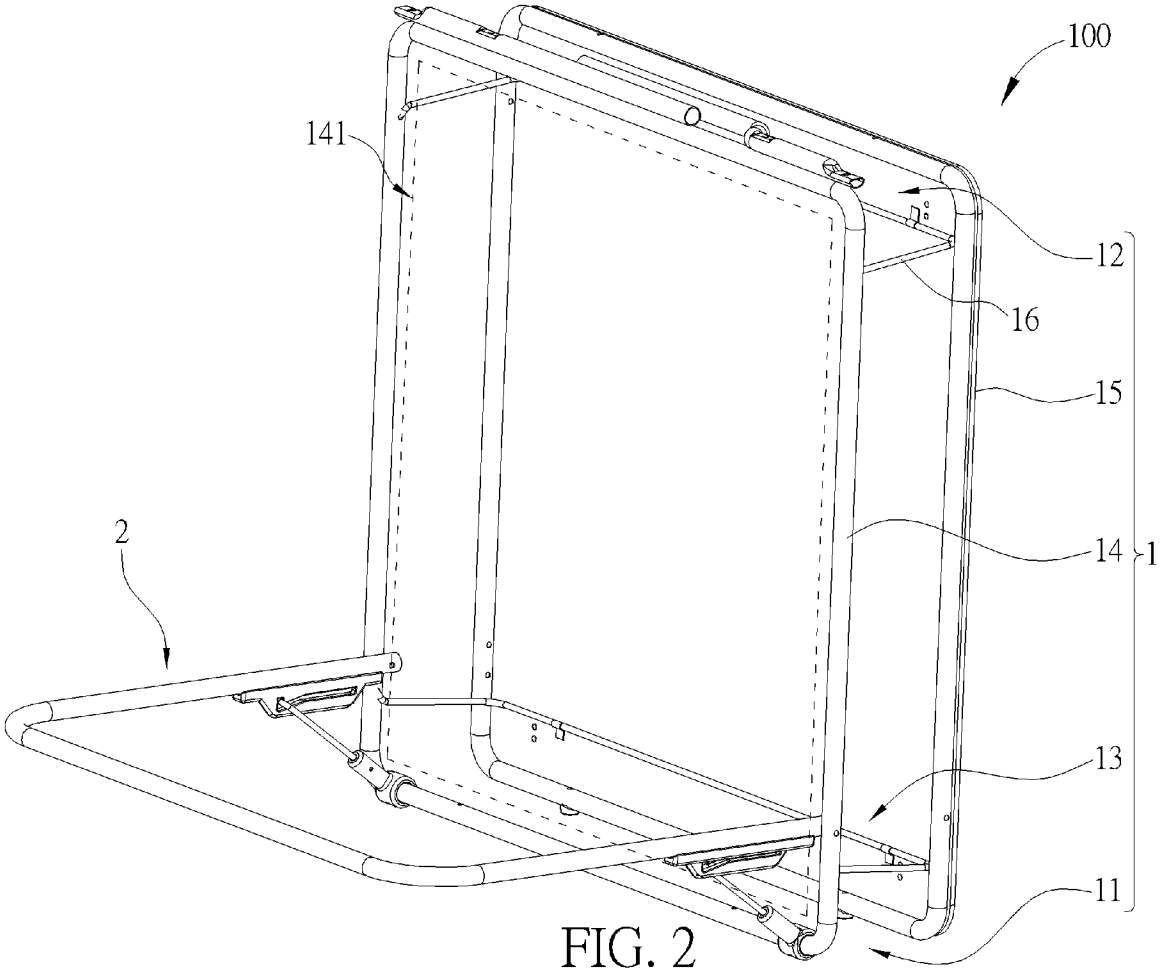
FIG. 2 is a schematic diagram of the portable baby supporting device where the platform is in a use status according to the embodiment of the invention.

Please refer to FIG. 1 and FIG. 2. FIG. 1 is a schematic diagram of a portable baby supporting device where a platform is in a stowed status according to an embodiment of the invention, and FIG. 2 is a schematic diagram of the portable baby supporting device where the platform is in a use status. A portable baby supporting device 100 according to the invention can be used beside the couch in the living room, which is typically the center of family life in the home. It can also be used in any possible circumstances such as the bedroom, the outdoor use, the restaurant, or places wherever a baby is to be taken care of. The portable baby supporting device 100 provides a means of storing all of the diaper changing essential items, parenting or medical supplies, entertainment accessories, etc., in a vertical or horizontal orientation, so that all the stuff as described may be well organized and packed.

The portable baby supporting device 100 includes a base 1 and a platform 2. The base 1 can be defined to have a first side 11 and a second side 12 opposite to each other. A mounting part 13 is also defined on the base 1 that is located between the first side 11 and the second side 12 as shown and pointed out in FIG. 1. In this embodiment, the base 1 includes a front main frame 14 and a rear main frame 15 parallel with each other, frame support wires 16, and soft goods (referring to FIG. 9). The platform 2 is rotatably coupled to the mounting part 13. As shown in FIG. 1 and FIG. 2, the platform 2 is configurable at a stowed status (a first position with respect to the base 1) in FIG. 1 and a use status (a second position with respect to the base 1) in FIG. 2. When the platform 2 is configured at the first position as shown in FIG. 1, the platform 2 is folded parallel with the base 1, in this embodiment, with a front main plane 141 (referring to FIG. 2) defined by the contour of the front main frame 14 to be more precisely, and can be fastened to the second side 12 of the base 1 by a snap or other fastening means. The platform 2 can be rotated out of the base 1 and configured at the second position as shown in FIG. 2. For the use status in FIG. 2, the base 1 may be placed on a flat surface, such as the surface of the floor, a bed, or a table, with the first side 11 and the platform 2 is opened perpendicular to the base 1, in this embodiment, to the front main plane 141 to be more precisely.

Figure 3:
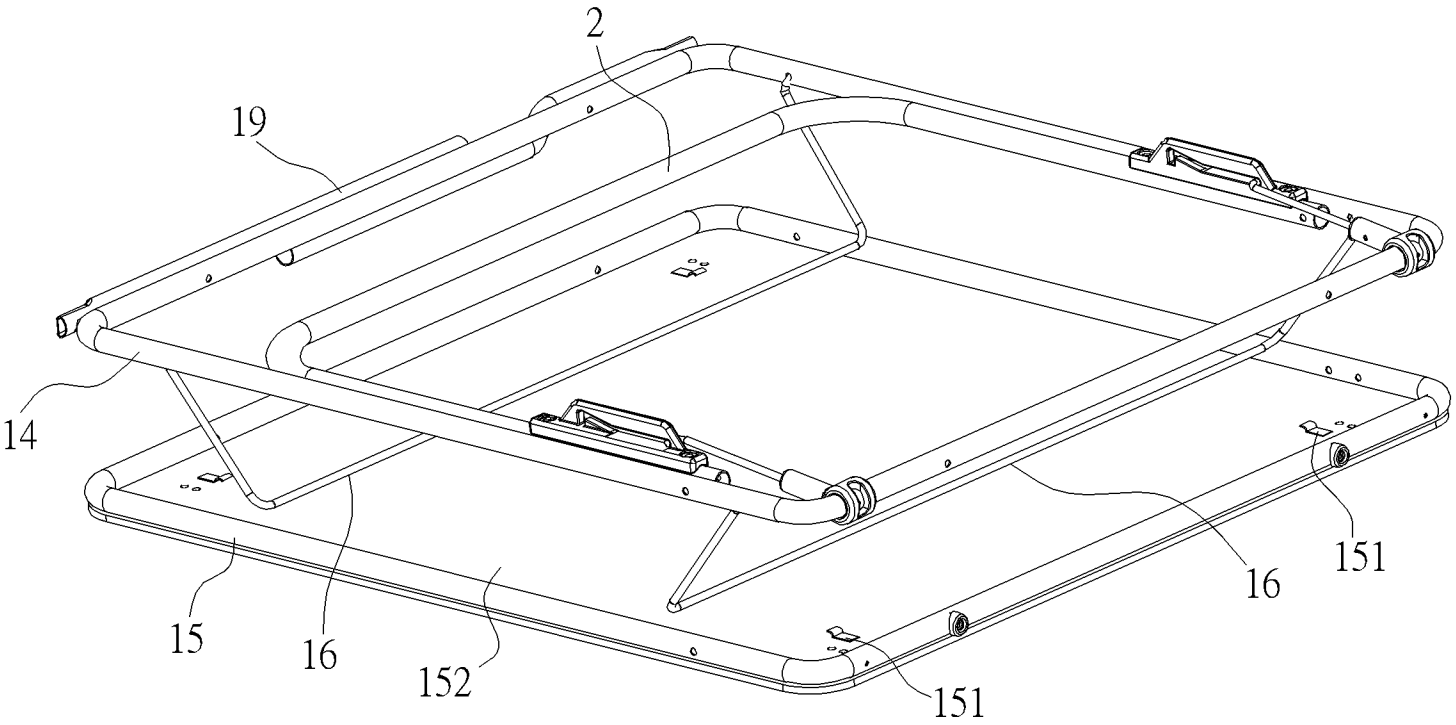
FIG. 3 is a schematic diagram of the portable baby supporting device during the transition between a setup position in FIG. 1 and a collapsed position.
Figure 4:
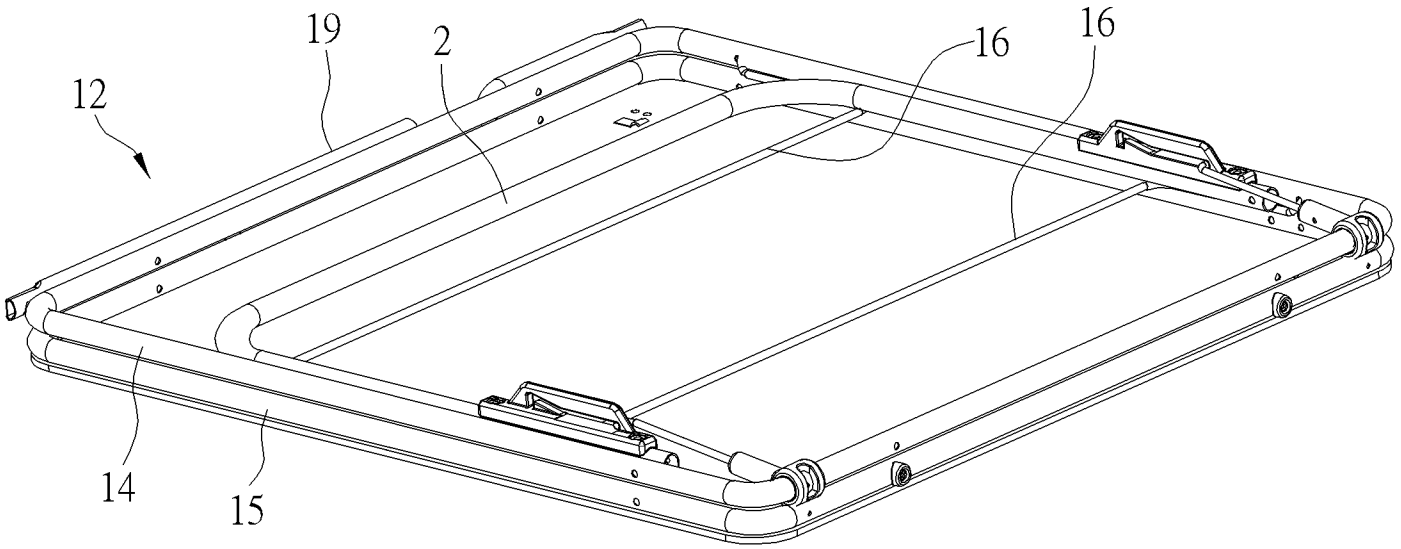
FIG. 4 is a schematic diagram of the portable baby supporting device in the collapsed position.

Please refer to FIG. 1, FIG. 3, and FIG. 4. FIG. 3 is a schematic diagram of the portable baby supporting device during the transition between a setup position in FIG. 1 and a collapsed position. FIG. 4 is a schematic diagram of the portable baby supporting device in the collapsed position. FIG. 3 and FIG. 4 show a process of the portable baby supporting device 100 from the setup position to the collapsed position. As previously mentioned, the base 1 includes the front main frame 14 and the rear main frame 15 parallel with each other. The front main frame 14 may be configured at a setup position as shown in FIG. 1 (and FIG. 2) with respect to the rear main frame 15. In the setup position, the base 1 is a box-like structure and the front main frame 14 is connected to, but apart from the rear main frame 15 for a gap to form a room 17 therebetween. To put it more specifically, a pair of frame support wires 16 are rotatably mounted on the front main frame 14 and can detachably engage with the rear main frame 15 (the other way around also applies in other embodiments of the invention). For the setup position in FIG. 1, the frame support wires 16 are rotated out of the front main frame 14 to engage with a plurality of clips 151 on a rigid panel 152 affixed to the rear main frame 15, so that the front main frame 14 can be supported by the frame support wires 16 and kept apart from the rear main frame 15 to form the room 17 at the setup position.

Figure 5:
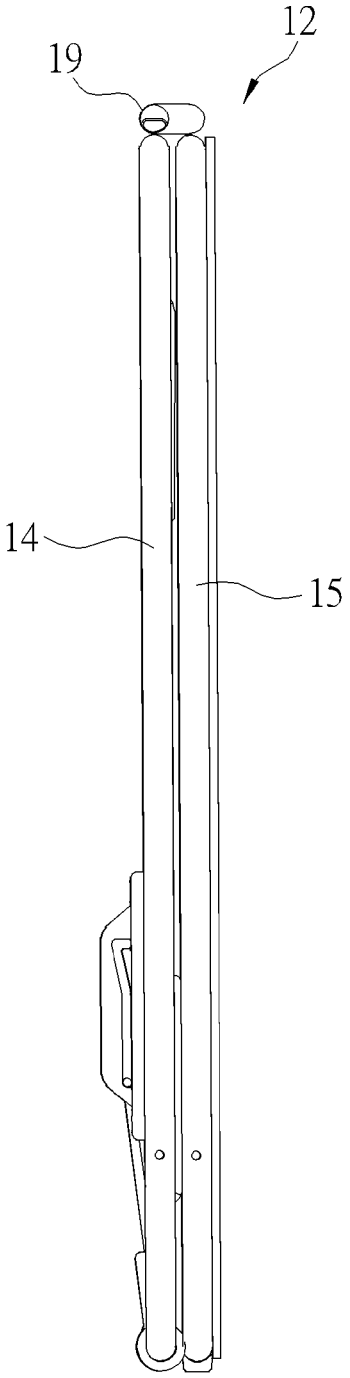
FIG. 5 is a schematic diagram showing a side view of the collapsed portable baby supporting device in FIG. 4.

Referring to FIG. 3, FIG. 4, and FIG. 5. FIG. 5 is a schematic diagram showing a side view of the collapsed portable baby supporting device in FIG. 4. Disengaging the frame support wires 16 from the clips 151 allows the frame support wires 16 to rotate and fold toward the front main frame 14, so that the front main frame can be disconnected from the rear main frame 15 and can be further configured at the collapsed position as shown in FIG. 4. In the collapsed position, the base 1 is now a flat structure. The opposite action is performed in order to erect the front main frame 14. In other embodiment, the base 1 may further include a locking device (not shown in FIG. 5) rotatably mounted on the second side 12 for use when the base 1 is collapsed. In this embodiment, the locking device is pivoted about the front main frame 14 (or the rear main frame 15 in other embodiment) and may be rotated to couple to the rear main frame 15 (or the front main frame 14 in other embodiment) when the front main frame 14 adjoins the rear main frame 15 at the collapsed position, so that the portable baby supporting device can be collapsed to a flat structure for storage (please referring to FIG. 5).

Figure 6:
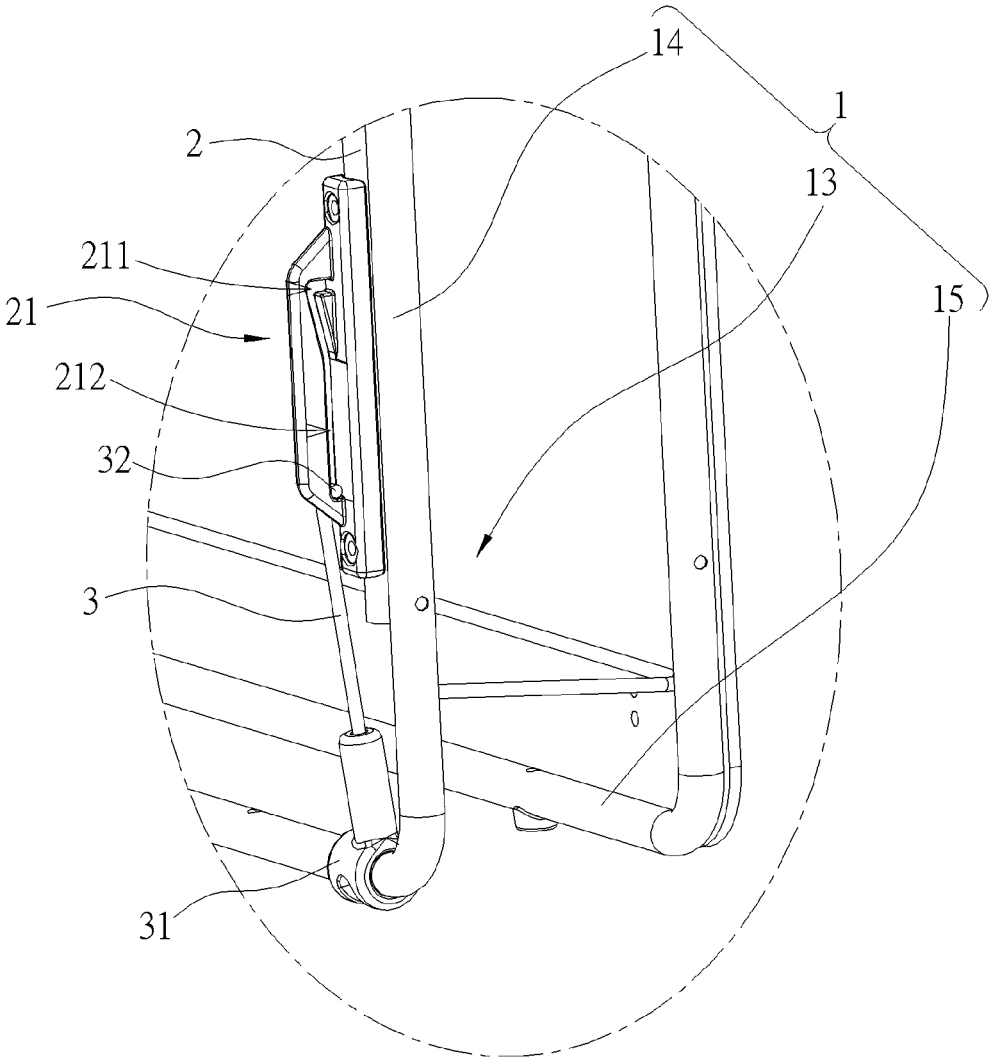
FIG. 6 is a schematic diagram showing a stop member, the base, and the platform when the platform is in the stowed status.
Figure 7:
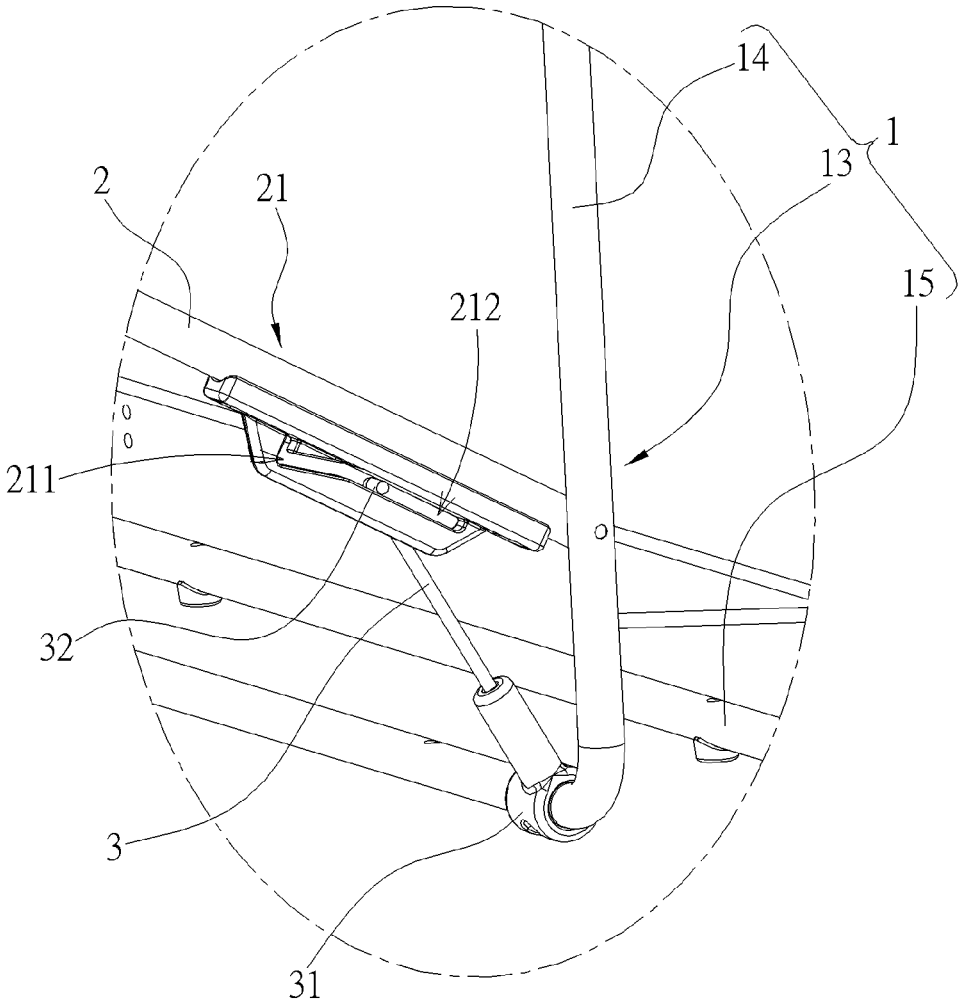
FIG. 7 is a schematic diagram showing the stop member, the base, and the platform during the transition between the stowed status and the use status.
Figure 8:
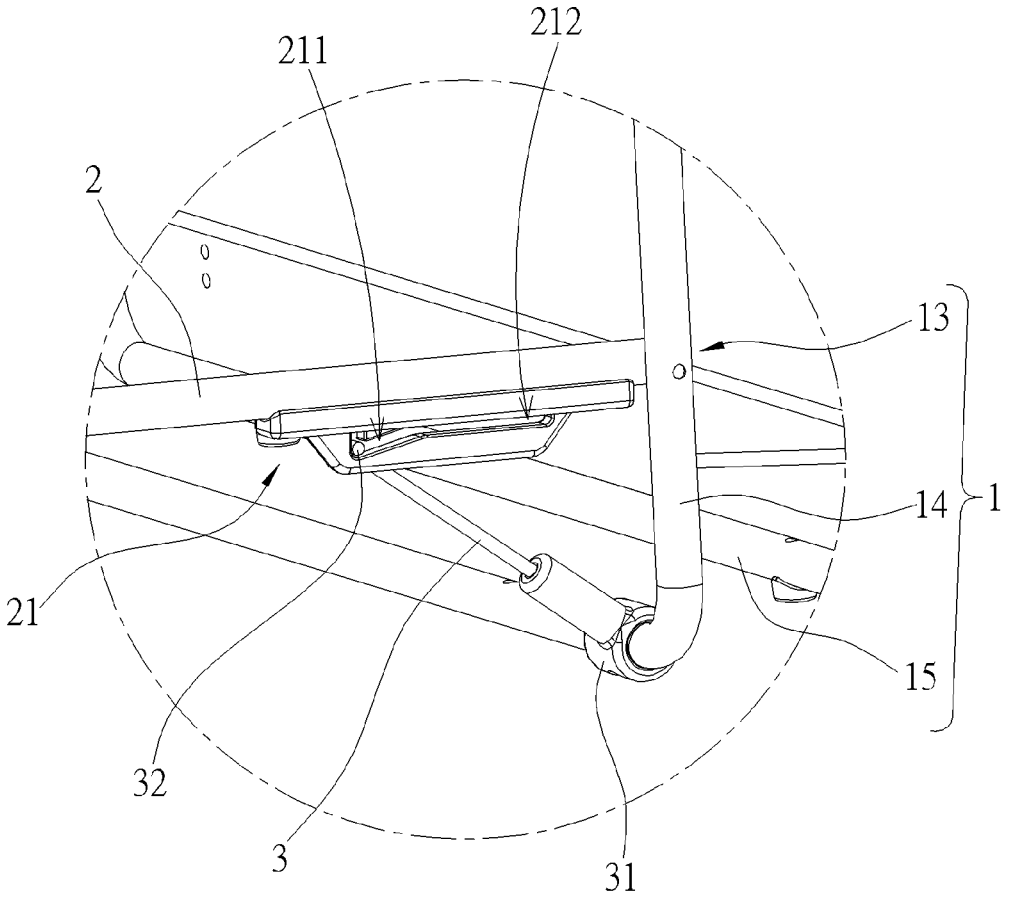
FIG. 8 is a schematic diagram showing the stop member, the base, and the platform when the platform is in the use status.

Please refer to FIG. 6~FIG. 8. FIG. 6 is a schematic diagram showing a stop member, the base, and the platform when the platform is in the stowed status, FIG. 7 is a schematic diagram showing the stop member, the base, and the platform during the transition between the stowed status and the use status, and FIG. 8 is a schematic diagram showing the stop member, the base, and the platform when the platform is in the use status. As seen in the figures, the platform 2, or the changer support wire, pivots about the front main frame 14 at the mounting part 13. In this embodiment, the platform 2 is a U-shape frame with both ends rotatably coupled to the mounting part 13. A stop member 3, or a pair of support wires, has one end 31 pivoted about the first side 11 of the base 1 (the front main frame 14, to be more precisely), and the other end 32 slidably connected to the platform 2. To put it more specifically, the platform 2 may further utilize a track 21 disposed near the mounting part 13 of the base 1 where the end 32 of the stop member 3 is slidably disposed within. The end 32 of the stop member 3 is then slidable between a front end 211 and a rear end 212.

For the stowed status in FIG. 6, the end 32 of the stop member 3 is located at the rear end 212 of the track 21 when the platform 2 is configured at the first position. For the use status in FIG. 8, the end 32 is located in the end 211 of the track 21 when the platform 2 is configured at the second position. It should be noted that the end 211 of the track 21 is made crooked, so that the end 32 of the stop member 3 can be securely locked into the position at the end 211 and the caregiver would need to perform some activity to disengage the stop member 3 in order to retract the platform 2 back to the first position or stowed status. FIG. 7 shows the status of transition between the use status and the stowed status.

Figure 9:
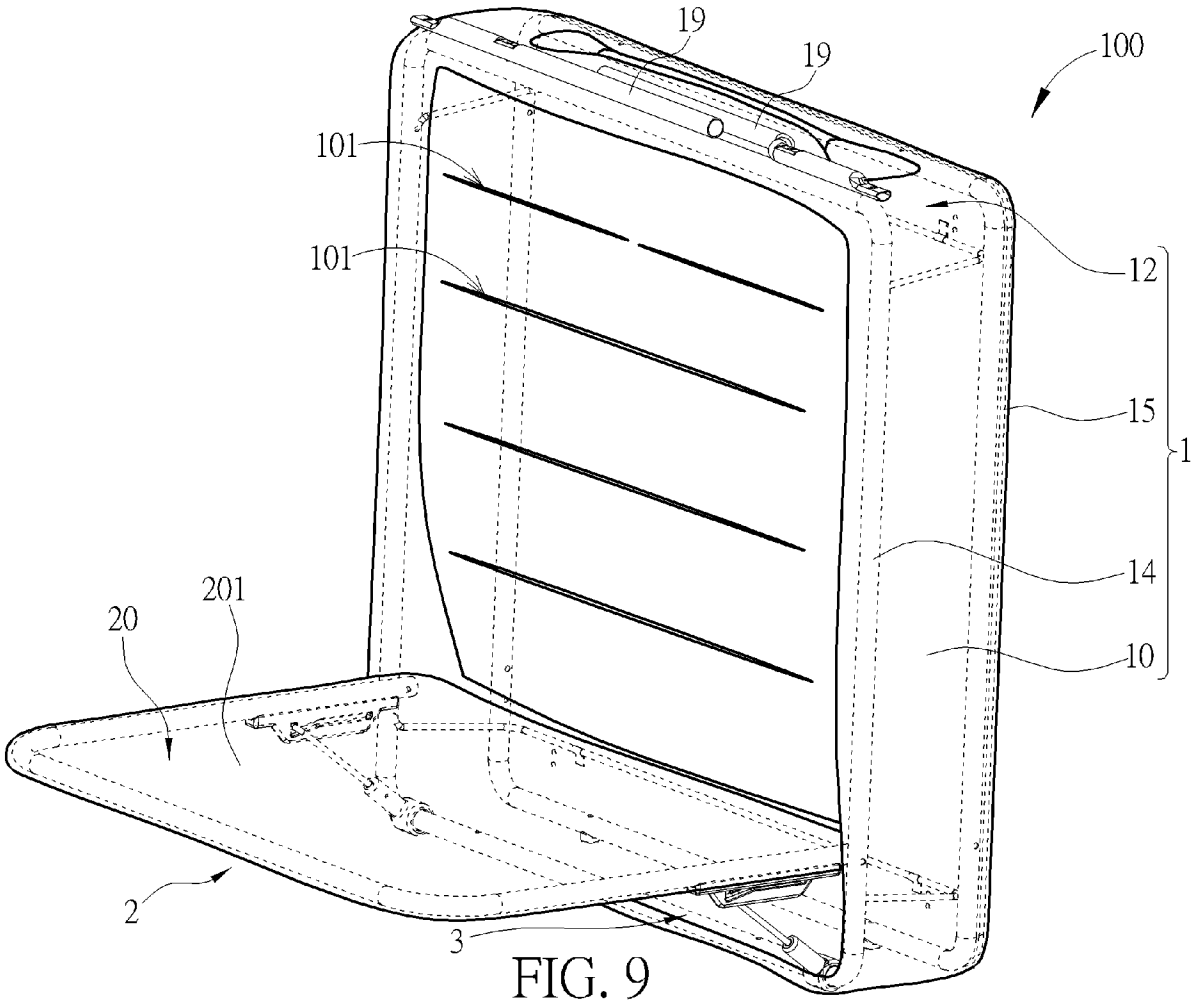
FIG. 9 is a schematic diagram of the portable baby supporting device in FIG. 2 with the soft goods thereon.

Please refer to FIG. 9. FIG. 9 is a schematic diagram of the portable baby supporting device in FIG. 2 with the soft goods thereon. Besides the seat and frame structure of the portable baby supporting device 100 as described above, some soft goods or softer fabric can be attached or wrapped around the frame structure. As shown in FIG. 9, the base 1 further includes a soft goods 10 wrapped around the front main frame 14 and the rear main frame 15. The soft goods 10 encloses the room 17 (not shown in FIG. 9) and can includes a plurality of storage compartments 101 for storing changing supplies, parenting or medical supplies, entertainment accessories, etc., needed during the use.

The platform 2 also includes a soft goods 20 wrapped around the U-shape frame for providing a first supporting surface 201. A baby can be place on the first supporting surface 201, which provides a cleanable place for diaper changing, feeding or entertaining purpose on the floor that is conveniently located adjacent to all of the necessary supplies in the storage compartments 101. Additionally, some type of outriggers (which is not shown in the figure) may also be incorporated that either flip or rotate from the bottom of the platform 2 down to provide extra stability to the portable baby supporting device 100 and prevent accidental tipping.

Figure 10:
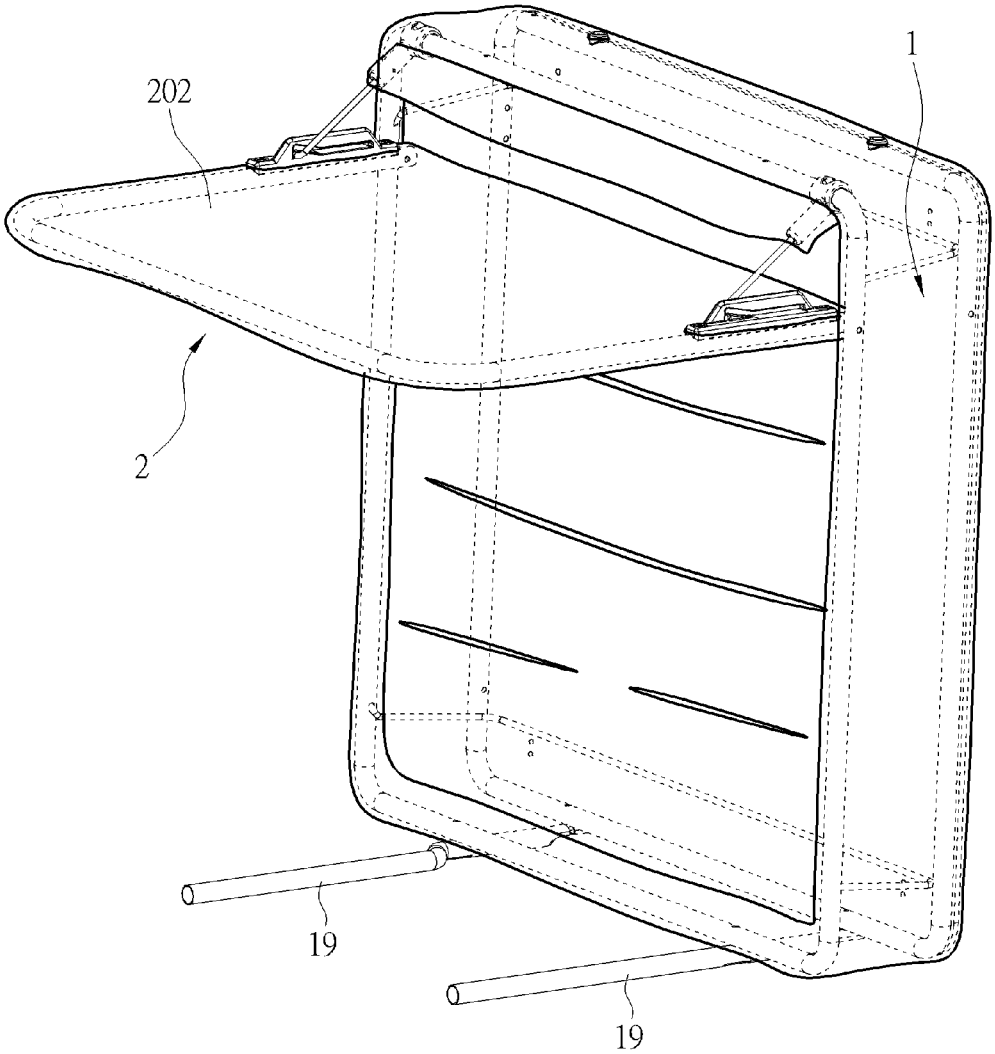
FIG. 10 is a schematic diagram of the portable baby supporting device in an 180 degrees flipped orientation for an alternative use with respect to the orientation in FIG. 2.

Please refer to FIG. 10. FIG. 10 is a schematic diagram of the portable baby supporting device in an 180 degrees flipped orientation for an alternative use with respect to the orientation in FIG. 2. It may be desirable to the caregiver for the changing surface to be higher, such as if the caregiver wanted to change the diaper either from a kneeling position or from a seated position on the couch or the bed. For this reason, the portable baby supporting device 100 may be used while it is flipped upside down as shown in FIG. 10. The base 1 further includes an outrigger 19 rotatably mounted at the second side 12. The outrigger 19 can be configured at a stowed position as shown in FIG. 9, or rotated like 90 or some degrees from the stowed position to a use position as shown in FIG. 10. In the orientation as shown in FIG. 10, the outrigger 19 is now rotated to the use position and the platform 2 is configured at the second position. The base 1 is placed on the flat surface with the outrigger 19 and the platform 2 provides a second supporting surface 202 for placing the baby, either when the baby needs to have his/her diaper changed or when the baby is sleeping thereon. Besides the stop member 3, additional securing means, which is not shown in FIG. 10, can be disposed between the base 1 and the platform 2 to further enhance the stability of the platform 2 in the second position. It should be noted that the soft goods 20 provides the first supporting surface 201 and the second supporting surface 202 at different sides respectively.

Figure 11:
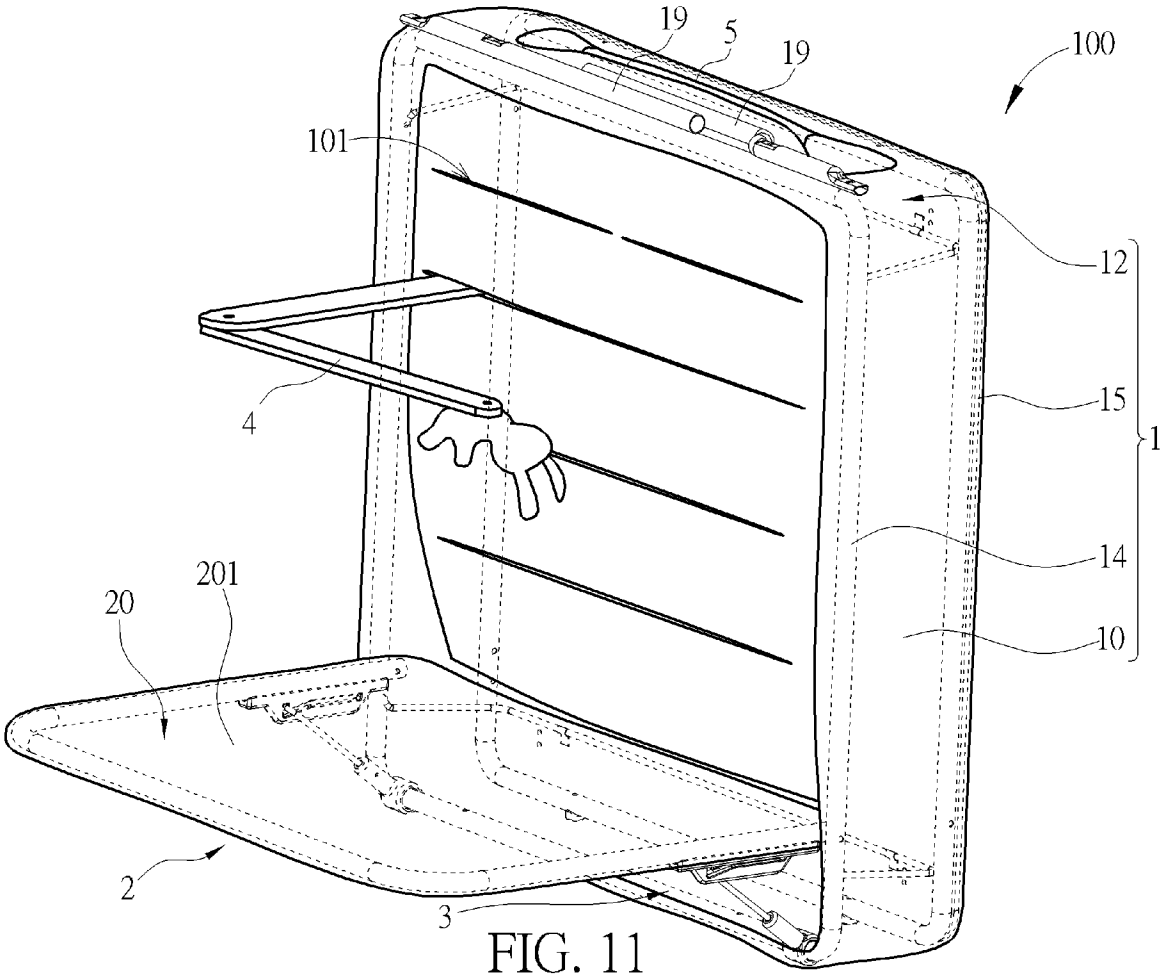
FIG. 11 is a schematic diagram showing additional functions of the portable baby supporting device.

Please refer to FIG. 11, which is a schematic diagram showing additional functions of the portable baby supporting device. The portable baby supporting device 100 may further include an auxiliary arm 4 rotatably coupled to the base 1. The auxiliary arm 4 may incorporate a toy that can be rotated out from the base 1 and help entertain the baby for a few moments during diaper changing. The toy could be an interactive one, such as a pull-down rattle or a mirror, or one that is motorized to help entertain the child for a few moments during diaper changing. The portable baby supporting device 100 further includes a handle 5 or a shoulder carrying strap affixed to the second side 12 of the base 1. When the caregiver wishes to move the portable baby supporting device 100 out of the way from beside the couch, the platform 2 can be rotated up and stowed, and the portable baby supporting device 100 can be easily lifted, moved, or stored to anywhere like a closet or under the couch.

The invention provides a portable baby supporting device designed to be used in any circumstance such as beside the couch in the living room, in the bedroom, or in outdoor activities, etc., and can be easily moved and stored to anywhere. The portable baby supporting device includes a base and a platform rotatably coupled to the base. The platform can either be stowed to be in parallel with the base or opened to be perpendicular to the base. When opened to a use status, the platform provides a first supporting surface for diaper changing, food feeding, entertaining, for the baby lying thereon. Necessary supplies can be stored in the compartments of the base in hand. The portable baby supporting device may also be collapsed to a minimized size for storage purpose, or oriented upside down, so that a higher changing table provided by the platform is accessible .

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A portable baby supporting device, comprising:

a base comprising a first side and a second side opposite to each other, and a mounting part located between the first side and the second side, the base being configurable at a setup position or a collapsed position; when configured at the setup position, wherein the base is a box shaped structure, and when configured at the collapsed position, the base is a flat structure, the base comprising:

a front main frame having four front main frame sides defining a front main plane;

a rear main frame parallel with the front main frame and comprising a plurality of clips on a rigid panel affixed to the rear main frame; and a pair of frame support wires rotatably mounted on the front main frame and engaging with the plurality of clips at the setup position;

wherein the front main frame is configurable at the setup position or the collapsed position with respect to the rear main frame; when configured at the setup position, the front main frame is connected to, but apart from the rear main frame by a distance to form a room therebetween; when configured at the collapsed position, the front main frame is disconnected from the rear main frame;

wherein the pair of frame support wires are rotated out of the front main frame to engage with the rear main frame and supporting the front main frame apart from the rear main frame to maintain the front main frame at the setup position, and the pair of frame support wires are disengaged from the rear main frame and rotated to fold toward the front main frame, so as to disconnect the front main frame from the rear main frame and maintain the front main frame at the collapsed position; and a platform rotatably coupled to the mounting part of the base and configurable at a first position or a second position with respect to the base, wherein when the platform is configured at the first position, the platform is folded parallel with the front main plane; when the platform is configured at the second position, the first side of the base is in contact with a flat surface, and the platform is opened to provide a first supporting surface for placing a baby and is perpendicular to the front main plane.

2. The portable baby supporting device of claim 1, wherein the mounting part is part of the front main frame and the platform is rotatably coupled to the mounting part of the front main frame.

3. The portable baby supporting device of claim 1, wherein the base further comprises a soft goods wrapped around the front main frame and the rear main frame to enclose the room formed therebetween when the front main frame is configured at the setup position.

4. The portable baby supporting device of claim 3, wherein the soft goods comprises a plurality of storage compartments.

5. The portable baby supporting device of claim 1, further comprising a stop member, one end of the stop member pivoted about the first side of the base and the other end of the stop member slidably connected to the platform.

6. The portable baby supporting device of claim 5, wherein the platform further comprises a track disposed near the mounting part of the base, the other end of the stop member disposed in the track and slidable between a front end and a rear end of the track.

7. The portable baby supporting device of claim 6, wherein the front end of the track is crooked and the other end of the stop member is locked in the crooked front end when the platform is configured at the second position; when the platform is configured at the first position, the other end of the stop member is located at the rear end of the track.

8. The portable baby supporting device of claim 5, wherein the stop member is a pair of support wires.

9. The portable baby supporting device of claim 1, wherein the base further comprises an outrigger rotatably mounted at the second side and configurable at a stowed position or a use position rotated from the stowed position.

10. The portable baby supporting device of claim 9, wherein when the outrigger is rotated to the use position and the platform is configured at the second position, the outrigger of the base is in contact with the flat surface and the platform provides a second supporting surface for placing the baby.

11. The portable baby supporting device of claim 10, wherein the platform further comprises a soft goods for providing the first supporting surface and the second supporting surface at both sides of the platform.

12. The portable baby supporting device of claim 1, wherein the platform is a U-shape frame with both ends rotatably coupled to the mounting part and the platform further comprises a soft goods wrapped around the U-shape frame for providing the first supporting surface.

13. The portable baby supporting device of claim 1, wherein when the platform is configured at the first position, the platform is fastened to the second side of the base by fastening means.

14. The portable baby supporting device of claim 1, further comprising an auxiliary arm rotatably coupled to the base for soothing or entertaining the baby.

15. The portable baby supporting device of claim 1, further comprising a handle or a shoulder carrying strap affixed to the base.

* * * * *